US010723424B2

(12) United States Patent
Pepis

(10) Patent No.: US 10,723,424 B2
(45) Date of Patent: Jul. 28, 2020

(54) BREATHING APPARATUS

(71) Applicant: Emanuel George Pepis, Bronx, NY (US)

(72) Inventor: Emanuel George Pepis, Bronx, NY (US)

( * ) Notice: Subject to any disclaimer, the term of this patent is extended or adjusted under 35 U.S.C. 154(b) by 180 days.

(21) Appl. No.: 16/038,788

(22) Filed: Jul. 18, 2018

(65) Prior Publication Data

US 2019/0135391 A1 May 9, 2019

Related U.S. Application Data

(60) Provisional application No. 62/533,806, filed on Jul. 18, 2017.

(51) Int. Cl.
*B63G 8/38* (2006.01)
*B63C 11/20* (2006.01)
*B63G 8/36* (2006.01)

(52) U.S. Cl.
CPC ..... *B63C 11/205* (2013.01); *B63G 8/36* (2013.01)

(58) Field of Classification Search
CPC ..... B63C 11/205; B63G 8/36
See application file for complete search history.

(56) References Cited

U.S. PATENT DOCUMENTS 4,276,851 A * 7/1981 Coleman ..... B63B 1/121 114/313
4,342,278 A * 8/1982 Horan ..... B63B 7/08 114/345
4,938,164 A * 7/1990 Onofri ..... B63C 11/42 114/312
5,528,923 A * 6/1996 Ledez ..... G01N 7/14 73/19.02
6,269,763 B1 * 8/2001 Woodland ..... A62C 29/00 114/144 A
6,325,012 B1 * 12/2001 Aristizabal ..... B63C 11/34 114/314
8,677,920 B1 * 3/2014 Jeng ..... B63B 3/08 114/312
8,869,729 B2 * 10/2014 Montousse ..... B63C 11/46 114/313
9,302,753 B2 * 4/2016 Montousse ..... B63C 11/46
9,969,471 B2 * 5/2018 Lin ..... B63B 34/00
2002/0083880 A1 * 7/2002 Shelton ..... H02K 5/1285 114/312
2008/0190849 A1 * 8/2008 Vuong ..... B01D 63/082 210/652
2015/0020799 A1 * 1/2015 Hipol ..... B63C 11/207 128/201.11
2019/0135391 A1 * 5/2019 Pepis ..... B63G 8/36

* cited by examiner

*Primary Examiner* — Lars A Olson
*Assistant Examiner* — Jovon E Hayes
(74) *Attorney, Agent, or Firm* — Antonio Papageorgiou; Meister Seelig & Fein LLP

(57) ABSTRACT

A breathing apparatus for a submersible craft is provided that includes a generally vertical tubular structure and a float configured to move vertically within the tubular structure between a first vertical position in which a third opening into the craft is unobstructed by the float and a second vertical position in which the third opening is fully obstructed by the float, and where the vertical position of the float is modulated based on the water level relative to the craft.

7 Claims, 2 Drawing Sheets

BREATHING APPARATUS

RELATED APPLICATION

This application claims the benefit of U.S. (Provisional) Application No. 62/533,806, filed Jul. 18, 2017.

BACKGROUND OF THE INVENTION

The present application relates to a submersible craft with and more particularly a craft with an apparatus for selectively allowing outside air into the craft when craft is above the water level.

Submersible crafts are known, but they typically involve high pressure tanks containing the air for occupants of the craft to breath under water. These systems have many drawbacks, including with regard to complexity and associated costs. Accordingly, there is a need for a breathing apparatus that is not so limited.

SUMMARY OF THE INVENTION

A breathing apparatus for a submersible craft, the breathing apparatus that includes: a vertical tubular structure having a first opening open to the atmosphere, a second opening open below a water line, and a third opening open to an interior of the craft; and a buoyant float disposed within a lumen of the tubular structure, the float configured to move vertically within the tubular structure between a first vertical position in which the third opening is unobstructed by the float and a second vertical position in which the third opening is fully obstructed by the float, and where the vertical position of the float is modulated based on the water level relative to the craft.

In at least one embodiment, the float includes a conduit passing vertically through the float, therewith allowing liquid entering the apparatus through the first opening to pass.

In at least one embodiment, the tubular member includes an upper stop.

In at least one embodiment, the tubular member includes a lower stop.

In at least one embodiment, the float includes a check valve that opens to allow liquid to pass through the float in a downward direction toward the waterline.

In at least one embodiment, the check valve prevents liquid from passing through the float in an upward direction.

In at least one embodiment, movement of the float within the tubular structure causes air to be drawn into and pushed out of the craft via the first and third openings.

Additional aspects of the present invention will be apparent in view of the description which follows.

DETAILED DESCRIPTION OF THE INVENTION

Figure 1:
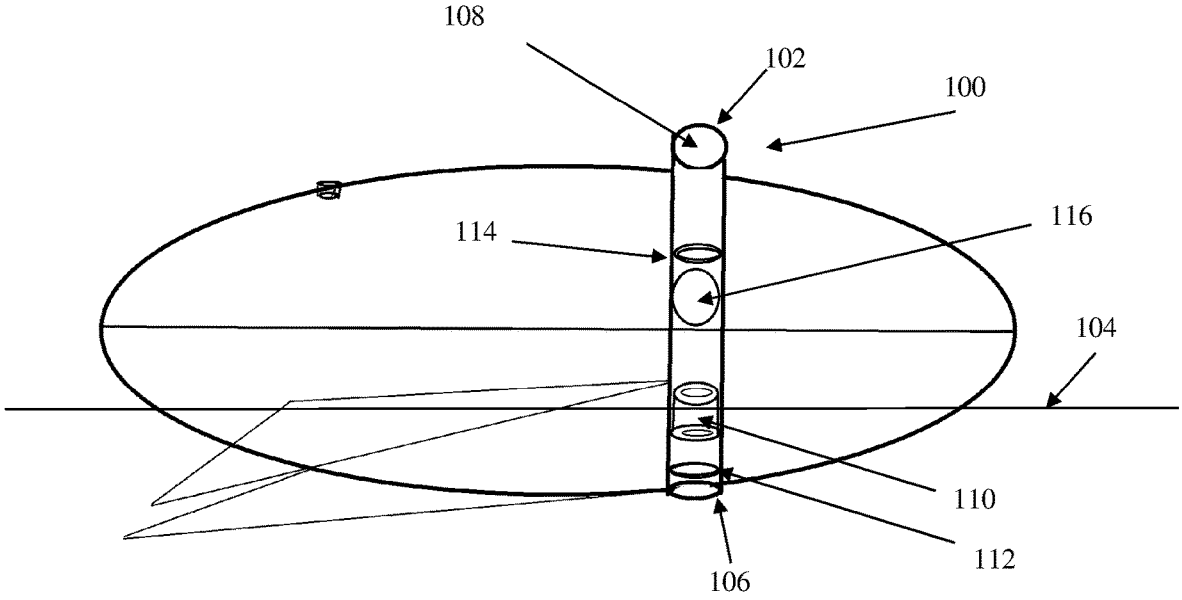
FIG. 1 is a diagram showing a submersible craft with the breathing apparatus according to one embodiment.
Figure 2:
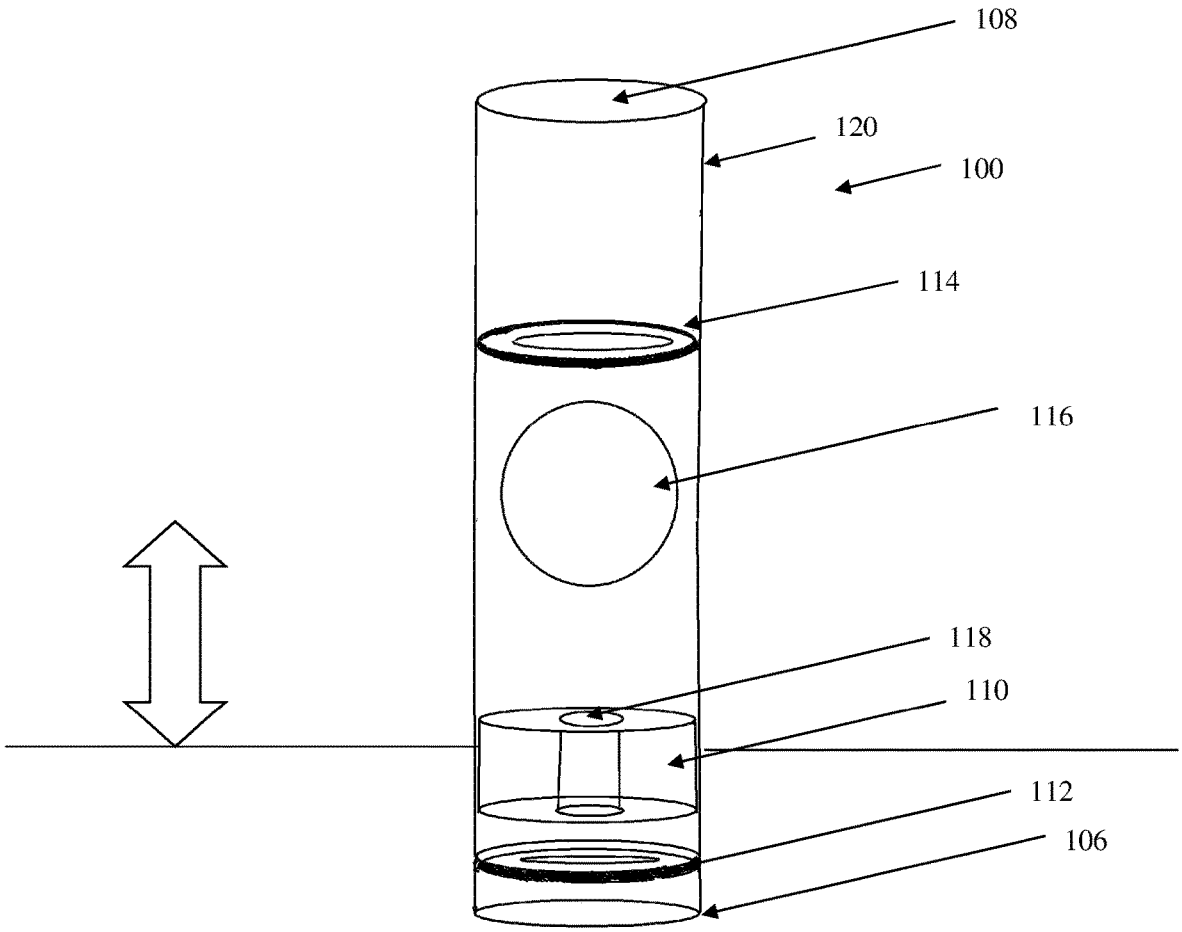
FIG. 2 is a diagram showing the breathing apparatus according to at least one embodiment.

Referring to FIGS. 1-2, a submersible craft 100 is provided with a breathing apparatus 102. The apparatus 102 generally includes a tubular structure 120 and a buoyant float 110 located within the tubular structure 120. The float

110 is generally free to move vertically within the subulate structure between an upper stop 114 and a lower stop 112. The tubular structure further includes a first opening 108 that is open to the atmosphere, as second opening 106 that is open below the waterline 104, and a third opening 116 open to the interior of the craft. Although the breathing apparatus is shown with regard to a submersible craft, it is understood that the apparatus may be used in other applications, including in scuba gear, etc.

As can be seen in FIG. 1, the float 110 is maintained at a level by the waterline 104 relative to the craft. Movement of the craft 100 based on wave motion, for example, will result in corresponding vertical movement of the float 110. In certain embodiments, the float 110 includes a check valve that opens allows liquid to flow in the downward direction toward the waterline. In this instance, the float 110 acts like a piston in which the downward vertical movement of the float 110 will draw air into the craft via first and third openings, and upward vertical movement of the float 110 will push air out from the craft via these openings. In a preferred embodiment, the float 110 includes a conduit 118 for the liquid to pass through the float 110 from the top to the bottom thereof (toward the waterline).

Although the tubular structure 120 is shown being circular, it is understood that the tubular shame may be square, rectangular, oval, etc. Also, the dimensions of the apparatus may vary depending on the application. For instance, a large craft may require larger openings and/or additional breathing structures for adequate air flow.

In operation, the float 110 is operable to move vertically within the structure 120 between at least a lower position and an upper position, each limited by the stops 112, 114, respectively. That is, the water level 104 at a lower position maintains the float 110 to allow continuity between the first and third openings, 108, 116, respectively. As the waterline 104 rises, for example, as the craft becomes submerged, the float 110 moves upward vertically within the tubular structure 120 to at least partially conceal the third opening 116 into the craft. At an uppermost position, the float 110 preferably covers the entirety of the third opening 116 so that liquid cannot enter the craft via the third opening 116. In the event that the craft becomes fully submerged, water entering the first opening 108 passes through the conduit 118 through the float 110. When the craft returns to the surface, float 110 returns to the lower position so that air can reenter into the craft via the first and third openings.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A breathing apparatus for a submersible craft, the breathing apparatus comprising:

a vertical tubular structure having a first opening open to the atmosphere, a second opening open below a water line, and a third opening open to an interior of the craft; and a buoyant float disposed within a lumen of the tubular structure, the float configured to move vertically within the tubular structure between a first vertical position in which the third opening is unobstructed by the float and a second vertical position in which the third opening is fully obstructed by the float, and wherein the vertical position of the float is modulated based on the water level relative to the craft.

2. The breathing apparatus of claim 1, wherein the float comprises a conduit passing vertically through the float, therewith allowing liquid entering the apparatus through the first opening to pass.

3. The breathing apparatus of claim 1, wherein the tubular member comprises an upper stop.

4. The breathing apparatus of claim 3, wherein the tubular member comprises a lower stop.

5. The breathing apparatus of claim 1, wherein the float comprises a check valve that opens to allow liquid to pass through the float in a downward direction toward the waterline.

6. The breathing apparatus of claim 5, wherein the check valve prevents liquid from passing through the float in an upward direction.

7. The breathing apparatus of claim 6, wherein movement of the float within the tubular structure causes air to be drawn into and pushed out of the craft via the first and third openings.

* * * * *